United States Patent [19]

Hennequin et al.

[11] Patent Number: 4,807,683

[45] Date of Patent: Feb. 28, 1989

[54] RETRACTABLE SCREEN

[75] Inventors: Petrus J. Hennequin, Rotterdam; Herman Oskam, Vlist, both of Netherlands

[73] Assignee: Hunter Douglas International N.V., Curacao, Netherlands Antilles

[21] Appl. No.: 940,140

[22] Filed: Dec. 10, 1986

[30] Foreign Application Priority Data

Dec. 27, 1985 [EP] European Pat. Off. ..... 85116592.8
Jan. 8, 1986 [DE] Fed. Rep. of Germany ... 8600264[U]

[51] Int. Cl.[4] ..... E06B 9/30
[52] U.S. Cl. ..... 160/172; 160/173
[58] Field of Search ..... 160/172, 173, 168 R, 160/178 R, 84 R, 166 R, 166 A, 107, 34

[56] References Cited

U.S. PATENT DOCUMENTS 2,389,956 11/1945 Castilonia ..... 160/176 X
2,557,978 6/1951 Krumm ..... 160/34
2,639,766 5/1953 Pratt ..... 160/172 X
4,444,241 4/1984 Amsler et al. ..... 160/172
4,673,018 6/1987 Judkins ..... 160/168 R X

FOREIGN PATENT DOCUMENTS 6918975 1/1969 Fed. Rep. of Germany .
1258091 10/1960 France .
8600264 7/1986 Netherlands .

*Primary Examiner*—Ramon O. Ramirez
*Assistant Examiner*—David M. Purol
*Attorney, Agent, or Firm*—Pennie & Edmonds

[57] ABSTRACT

A retractable screen comprising a head rail, lateral profiles extending generally perpendicular from each end of the headrail, a bottom rail having end portions movable in said lateral profiles, draw-cords connected to said bottom rail, a slide mounted on one of said lateral profiles, passages formed in said slide, said passages opening into the front face of said slide, the draw-cords passing through said passages, operation of said draw-cords causing raising or lowering of said bottom rail, said draw-cords extending to the front of said slide, so that they may be manually gripped and pulled.

8 Claims, 2 Drawing Sheets

RETRACTABLE SCREEN

BACKGROUND OF THE INVENTION

The present invention relates to a retractable screen, such as a venetian blind, a folding blind or curtain or a roller blind which can be gathered together.

One known form of such screen comprises a headrail, lateral profiles extending generally perpendicular from each end of the headrail, a bottom rail having end portions movable in said lateral profiles and draw-cords connected to the bottom rail. The draw-cords may be connected to a slide which is mounted for movement along the lateral profile so that movement of this slide actuates the bottom rail via the draw-cords. The slide, however, does not permit the bottom rail to move up and down other than by means of the slide, so that, particularly in the event of failure or seizure of the slide, the blind cannot be moved up or down.

SUMMARY OF THE INVENTION

It is an object of the present invention to improve the slide of the type mentioned initially, in such a way that other means may be provided for actuating the retractable screen.

According to the present invention there is provided a retractable screen comprising a head rail, lateral profiles extending generally perpendicular from each end of the headrail, a bottom rail having end portions movable in said lateral profiles, draw-cords connected to said bottom rail, a slide mounted on one of said lateral profiles, passages formed in said slide, said passages opening into the front face of said slide, the draw-cords passing through said passages, operation of said draw-cords causing raising or lowering of said bottom rail, said draw-cords extending to the front of said slide, so that they may be manually gripped and pulled.

The movement of the bottom rail can be achieved simply by manually acting on those portions of the draw-cords which extend to the front of the slide, the slide normally then being fixed in position on one of the lateral profiles.

Preferably, however, provision is provided to clamp the draw-cords to the slide, whereby movement of the slide longitudinally of said one profile will cause movement of the draw-cords and thus of the bottom rail. With such a construction, however, it is possible preferably to release the clamping means and to adjust manually the portion of the draw-cord which is at the front of the slide. This overcomes the problem when one or more of the draw-cords is lying too loosely in the retractable screen and has to be tightened. This retightening can be readily achieved by the release of the clamping means in the slide, pulling on the cords and reclamping. This can be carried out even by an unskilled person.

In a preferred construction, the slide is generally rectangular, having two longer and two shorter sides, and possibly being rounded at the shorter sides. With such a construction, it is preferable that the passages on the two shorter sides of the side should each begin in the region of a part of the slide which extends in a longitudinal channel formed in the lateral profile. The passages may include a first arm parallel to the lateral profile and a second arm essentially perpendicular thereto.

The clamping means, where provided, may comprise a screw having a portion engageable with the cord passing through the passage. This portion may be the head of the screw and the screw shank can be arranged to extend parallel to the second arm of the passage.

Simple and easy locking of the slide may be achieved if a locking member is movable in the slide substantially perpendicular to the lateral profile, and has a head part engaging in the profile so as to be moved relative to the rest of the slide in order to exert a clamping pressure on the profile. The locking member can include a thread on the front face of the slide, on which a nut is threadably engaged to exert the clamping force. A nut of this type can be actuated particularly easily by hand, on the front face of the slide, without the use of tools.

In order that the invention may more readily be understood, the following description is given, merely by way of example, reference being made to the accompanying drawings.

DESCRIPTION OF THE PREFERRED EMBODIMENT

The retractable screen on which the slide is to be used may be a venetian blind, a folding blind, a folding curtain or a roller blind. The invention is described with reference to a venetian blind.

Figure 3:
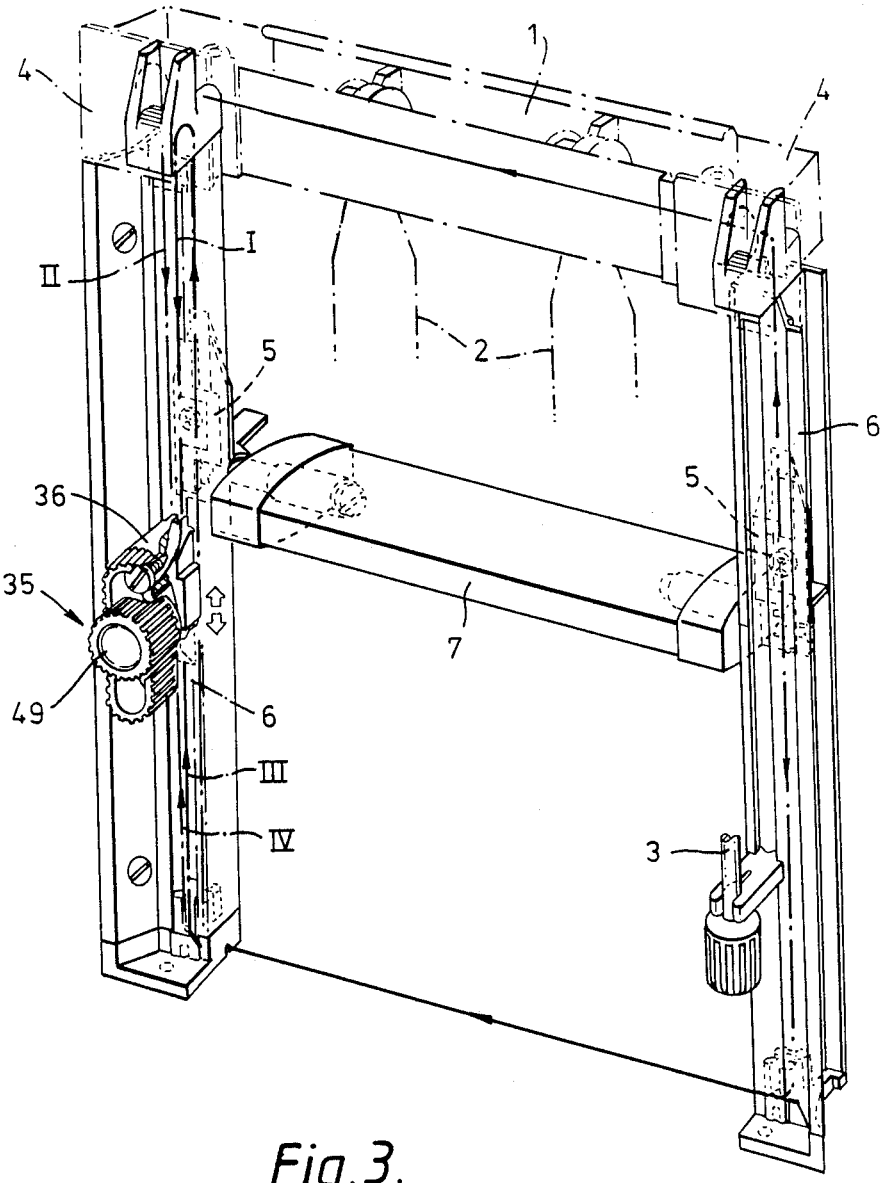
FIG. 3 is a perspective view of a complete venetian blind constructed according to the invention, provided with a slide according to FIGS. 1 and 2.

FIG. 3 shows such a blind which can be fitted to the inside of a sloping skylight, particularly of the tiltable type. The blind has a horizontal headrail 1, which is U-shaped in cross-section and from which ladder cords 2 hang down, these ladder cords being indicated in broken lines in FIG. 3 and holding the individual slats, which are not shown, at the necessary distance apart from one another. A longitudinal tilt rod (not shown) is mounted in a conventional manner in the headrail 1 and can be rotated by means of a tilt bar 3 in order to turn the slats by means of the ladder cords 2.

Projections formed on corner parts 4 are pushed into the end of the headrail 1, these corner parts 4 forming the connection between the headrail 1 and lateral profiles 6. The lateral profiles 6 are fixed to the lower parts of the generally square shaped corner parts 4 and extend downwards on both sides of the window, so that in the case of a sloping skylight, the profiles 6 are parallel to the sloping window side pieces.

Two lateral profiles 6 are each formed with a front and a rear channel through which the venetian blind draw-cords can run. These channels are open to the front and rear, respectively, over their entire length.

Figure 1:
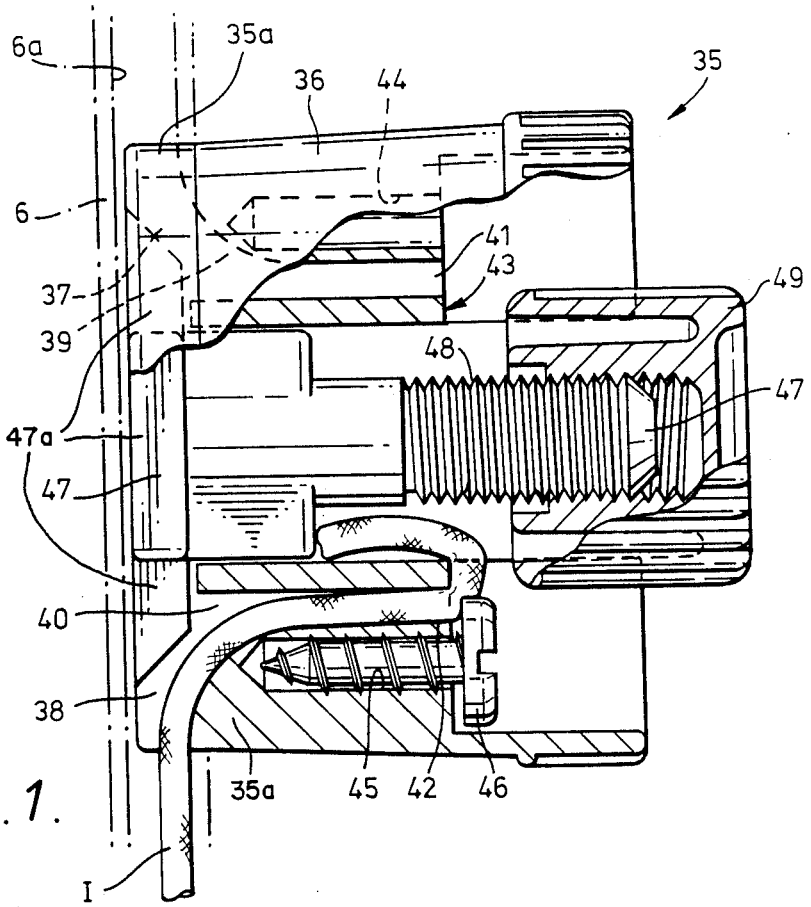
FIG. 1 is a half section through one embodiment of a slide shown installed in one form of retractable screen according to the invention.
Figure 2:
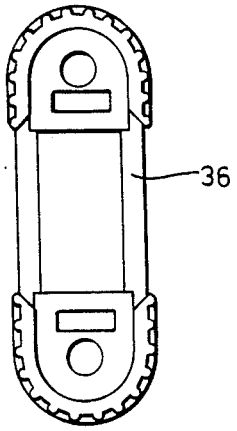
FIG. 2 is a front view of the slide housing.

In the front channel of the left profile 6 a handle or manually actable slide 35 can be moved up and down along the profile. This slide has a housing 36 which is approximately square as seen in the cross-section in FIG. 1, and approximately rectangular in end view as seen in the orthogonal view of FIG. 2. The bottom part **35*a* of the slide 35 extends into the channel, engaging inturned side pieces of the channel. When assembled together with a clamping member 47 discussed below the slide 35 is clamped to the profile 6. Lift cords (I to IV) are arranged in the front channel and are threaded into the slide 35 on both shorter sides of the housing in the bottom part 35***a*. For this purpose the slide 35 has apertures 37, 38 on both shorter sides, which represent the start of passages 39,40 in the housing 36. These passages 39,40 are curved, beginning in portions extending parallel to the profile 6 and ending in the apertures 37,38 and end in portions extending perpendicular to the profile 6, which terminate in the apertures 41,42 on the front of the housing 36 as seen in FIG. 1. In this context, the housing 36 may have a recessed region on its front, so that part of the housing front is recessed at 43, the apertures 41,42 being shown opening into this part 43.

Holes 44, 45 are drilled in the housing 36 from the front, parallel to the portions of the passages 39,40 extending perpendicular to the profile 6 and self-tapping, clamping screws 46 are screwed into these holes, so that the screw heads clamp the cords firmly relative to the slide 35. Alternatively, however, clamping means of other designs can also be provided to clamp the cords I to IV. For example, levers with cams can be pivoted on the housing, the cams of the levers clamping the cord firmly. This has the advantage that the cords can be released manually, without the use of tools.

Approximately at the centre of the housing 36, at right angles to the profile 6, a generally T-shaped clamping member 47 is inserted in the housing 36. Ears 47*a* extending longitudinally and laterally from the member 47 engage the under side surfaces of the inturned side pieces of the channel of the profile 6 which face in a direction opposite the front of the housing. At its front, the clamping part 47 has a threaded post 48 on which is screwed a cap nut 49. If this nut 49 is tightened, its lower surface engages a recessed surface 43 of the housing, and thus pulls the ears 47*a* of clamping member 47 outwardly so that the ears 47*a* of the clamping member 47 and the bottom part 35*a* clamp the inturned side pieces between them to lock the slide 35 to the profile 6.

In this position, it may be advantageous to release the clamping means 46 and to bring the cords I to IV sufficiently far forward out of the slide 35 to enable them to be pulled manually, to move carriage 5 slidably in the side profiles 6 in order to raise or lower the bottom rail 7 of the blind, which is carried by the carriage 5. Normal raising or lowering of the bottom rail 6 is achieved with the cords clamped by the screws 46, that is, by raising or lowering the slide 35.

The clamping means 46 can be temporarily slackened off and any looseness in the cords I to IV can be removed by pulling on the portion of the cords I to IV which extend to the front of the slide housing.

In the alternative, one can release or indeed remove the screws 46 and adjustment of the blind can be achieved by pulling on the free part of the draw cords which extend to the front of the slide housing. This could be done if, by some chance, the slide housing should become jammed, or if it were for some reason undesirable to loosen the nut 49.

We claim:

1. A retractable screen lying in a predetermined plane and comprising a headrail having ends, lateral profiles having channels therein and extending perpendicular from each end of the headrail, a bottom rail having end portions movable in said lateral profiles, draw-cords connected to said bottom rail and disposed in the channels formed in said profiles, a slide mounted for movement along one of the said lateral profiles and having a front face facing away from said lateral profiles and said plane, said slide having passage means formed therein, said passage means extending from said channels and opening into the front face of said slide, the draw-cords passing through said passage means, operation of said draw-cords causing raising or lowering of said bottom rail, said draw-cords extending to the front face of said slide and out of said one profile, so that they may be pulled, and a first clamping means for releasably clamping said slide with respect to said one of said lateral profiles, a second clamping means for clamping said draw-cords to said slide; wherein, when said second clamping means is in an engaged position clamping said draw-cords to said slide, said draw-cords are operable solely by movement of said slide; and wherein, when said second clamping means is in a disengaged position, said draw-cords are operable solely by manual gripping and pulling thereof.

2. A retractable screen as claimed in claim 1, wherein said second clamping means comprises a screw threaded into said slide and having a part positioned to clamp a draw cord.

3. A retractable screen as claimed in claim 1, wherein the lateral profiles each include longitudinal channels therein, wherein the slide includes a portion engaged in the longitudinal channel of one of said profiles, the slide being generally rectangular, having two longer and two shorter sides, and wherein the passage each begin on the two shorter sides of the slide in the portion engageable in the longitudinal channel of the lateral profile.

4. A retractable screen as claimed in claim 3, wherein the passage means each have a first portion extending parallel to the longitudinal channels in the lateral profiles, and a second portion extending substantially perpendicular thereto.

5. A retractable screen as claimed in claim 4, and further comprising a screw threaded into said slide and having a part positioned to clamp a draw cord, wherein said screw is screwed into said slide parallel to the second portion of said passage.

6. A retractable screen as claimed in claim 1, wherein said first clamping means is displaceable relative to said slide in a direction generally perpendicular to said one of said lateral profiles, said first clamping means including a head portion engageable with said one lateral profile, so as to be lockable thereto.

7. A retractable screen as claimed in claim 6, wherein the first clamping means further comprises a threaded post on the front face of the slide, and a locking nut threadable onto said threaded post whereby tightening of said locking nut locks the head part and thus the slide relative to said profile.

8. A retractable screen lying in a predetermined plane and comprising a headrail having ends, lateral profiles having channels therein and extending perpendicular from each end of the headrail, a bottom rail having end portions movable in said lateral profiles, draw-cords connected to said bottom rail and disposed in the channels formed in said profiles, a slide mounted for movement along one of the said lateral profiles and having a front face facing away from said lateral profiles and said plane, said slide having passages formed therein, said passages extending from said channels and opening into the front face of said slide, the draw-cords passing through said passages, operation of said draw-cords causing raising or lowering of said bottom rail, said draw-cords extending to the front face of said slide, so that they may be pulled, and a clamping member for clamping said slide with respect to said one of said lateral profiles, said clamping member being displaceable relative to said slide in a direction generally perpendicular to said one of said lateral profiles, said clamping member including a head portion engageable with said one lateral profile, so as to be lockable thereto and a threadable post on the front face of the slide, and a locking nut threadable onto said threaded post whereby tightening of said locking nut locks the head part and thus the slide relative to said profile.

* * * * *